US005590449A

United States Patent [19]

Chehab et al.

[11] Patent Number: 5,590,449

[45] Date of Patent: Jan. 7, 1997

[54] APPARATUS FOR STRETCHING PLASTICIZING AND GATHERING A TOW OF FILTER MATERIAL FOR TOBACCO SMOKE

[75] Inventors: Firdausia Chehab, Hamburg; Stefan Fietkau, Westerau; Peter-Franz Arnold, Hamburg, all of Germany

[73] Assignee: Hauni Maschinenbau AG, Hamburg, Germany

[21] Appl. No.: 334,181

[22] Filed: Nov. 3, 1994

[30] Foreign Application Priority Data

Nov. 24, 1993 [DE] Germany ..... 43 40 029.9

[51] Int. Cl.[6] ..... D02J 1/22; D02J 1/18

[52] U.S. Cl. ..... 28/240; 28/282

[58] Field of Search ..... 28/282, 283, 247, 28/258, 271, 219, 220, 240, 244, 246; 226/108, 109, 119; 68/5 R, 5 B, 5 D; 493/39, 42, 44, 50

[56] References Cited

U.S. PATENT DOCUMENTS 3,255,506 6/1966 Fritz .
3,317,965 5/1967 Murakami .
3,817,211 6/1974 Brown et al. .
4,259,769 4/1981 Greve et al. .
4,313,974 2/1982 Greve et al. .

OTHER PUBLICATIONS

Defensive Publication No. 665,476 –Official Gazette of Mar. 18, 1969.

*Primary Examiner*—Andy Falik
*Assistant Examiner*—Larry D. Worrell, Jr.
*Attorney, Agent, or Firm*—Darby & Darby

[57] ABSTRACT

An apparatus for processing one or more tows of filamentary filter material for tobacco smoke between one or more bales and the inlet of a filter rod making machine defines for each tow an elongated path having a substantially U-shaped or V-shaped part. Successive increments of the tow are stretched at least while advancing downwardly along one one leg of the U-shaped or V-shaped part of the path, and successive increments of the tow are gathered while advancing upwardly along the other leg of the U-shaped or V-shaped part of the path. A unit which serves to spray a plasticizing agent against the filaments of the tow is adjacent the substantially horizontal portion between the lower ends of the legs of the U-shaped part or is adjacent the lower region of the other leg of the V-shaped part of the path. The length of the one leg of the U-shaped or the V-shaped part of the path need not exceed 1200 mm, and the maximum width of the tow need not exceed 150 mm.

35 Claims, 2 Drawing Sheets

APPARATUS FOR STRETCHING PLASTICIZING AND GATHERING A TOW OF FILTER MATERIAL FOR TOBACCO SMOKE

BACKGROUND OF THE INVENTION

The invention relates to improvements in apparatus for processing one or more tows of filamentary filter material, particularly for processing one or more tows of filamentary material which can be used to filter tobacco smoke in filter cigarettes, cigars, cigarillos and/or other rod-shaped articles of the tobacco processing industry. Still more particularly, the invention relates to improvements in apparatus which are provided with means for stretching, selectively softening and gathering running tows of filamentary filter material prior to conversion of the thus treated tows into substantially rod-shaped fillers ready to be draped into webs of cigarette paper, artificial cork or other wrapping material. The resulting filter rods are thereupon severed at regular intervals to yield filter mouthpieces of unit length or multiple unit length, and such mouthpieces can be put to storage or are delivered directly to so-called tipping machines to be assembled with plain cigarettes, cigars, cigarillos or other rod-shaped tobacco containing products into filter cigarettes, cigars, cigarillos or other filter tipped rod-shaped articles of unit length or multiple unit length.

OBJECTS OF THE INVENTION

An object of the invention is to provide a simple, compact and inexpensive apparatus for treating one or more tows of filamentary filter material for tobacco smoke.

Another object of the invention is to provide the apparatus with novel and improved combinations of means for stretching, selectively softening and gathering one or more tows of filamentary filter material for tobacco smoke.

A further object of the invention is to provide an apparatus whose versatility at least matches that but whose space requirements are less than those of heretofore known apparatus for treating one or more tows of filamentary filter material for tobacco smoke.

An additional object of the invention is to provide novel and improved paths for advancement of one or more tows of filamentary filter material past stretching, softening, gathering and (if necessary) other treating stations ahead of one or more magazines for filter rod sections or ahead of one or more filter tipping machines for cigarettes or other rod-shaped tobacco containing products of the tobacco processing industry.

Still another object of the invention is to provide novel and improved combinations of plural units for stretching the filaments of one or more running tows of filter material.

A further object of the invention is to provide a novel and improved method of treating one or more continuous tows of filamentary filter material for tobacco smoke in a small area without affecting, or without unduly affecting, the quality of treatment.

Another object of the invention is to assemble an apparatus of the above outlined character from parts or groups of parts which are available to or in the plants for making filter rod sections for use in tipping machines for cigarettes or the like.

An additional object of the invention is to provide an apparatus which can be readily converted from the treatment of a single tow to the treatment of plural tows of fibrous filter material or vice versa.

Still another object of the invention is to provide a novel and improved tow which has been treated in the apparatus and in accordance with the method of the present invention.

A further object of the invention is to provide an apparatus which constitutes an improvement over and a further development of apparatus known as AF 1, AF 2 and AF 3, all distributed by the assignee of the present application.

SUMMARY OF THE INVENTION

One feature of the present invention resides in the provision of an apparatus for treating at least one continuous tow of filamentary filter material for tobacco smoke. The improved apparatus comprises means for advancing the at least one tow from a source (e.g., a bale) along a predetermined path in a predetermined direction, means for stretching the filamentary filter material (hereinafter called filaments for short) of the at least one tow in a first portion of the path, means for applying at least one treating agent (e.g., a liquid softening agent such as triacetin) to the stretched filaments of the at least one tow in a second portion of the path downstream of the first portion, and means for gathering the filaments of the at least one tow in a third portion of the path downstream of the second portion. The first, second and third portions together constitute a substantially U-shaped part of the predetermined path. The applying means can comprise means for spraying the softening agent onto the stretched filaments of the at least one tow in the second portion of the path. Successive increments of the at least one tow advancing beyond the applying means have a first width, and the gathering means includes means for reducing the width of successive increments of the at least one tow in the third portion of the path.

In accordance with a presently preferred embodiment, the first portion of the path has a length of between approximately 800 mm and 1200 mm, preferably approximately 1000 mm.

The stretching means can include a first set (e.g., a pair) of rotary tow contacting elements (e.g., in the form of rolls having substantially parallel axes and disposed at opposite sides of the first portion of the path) which are driven at a first peripheral speed (e.g., by the at least one tow), and a second set (e.g., a pair) of rotary tow contacting elements (e.g., in the form of rolls having at least substantially parallel axes and disposed at opposite sides of the first portion of the path downstream of the first set of tow contacting elements) which are driven (e.g. by a variable-speed prime mover) at a second peripheral speed higher than the first speed and engage successive increments of the advancing tow downstream of the first set of rotary elements, as seen in the predetermined direction.

At least one of the stretching and applying means can include means for imparting to the at least one tow a width of between approximately 120 and 150 mm in the respective portion of the predetermined path.

The first portion of the path is, or can be, at least substantially vertical and the stretching means can include means for moving successive increments of the at least one tow from a higher level to a lower level.

The aforementioned part of the predetermined path can include a downwardly sloping first leg and an upwardly sloping second leg. The first portion of the predetermined path can form part of the first leg, and the second and third portions of such path can form part of the second leg. The gathering means can be at least closely adjacent the applying means, i.e., the second portion can be disposed immediately adjacent the third portion of the predetermined path.

The stretching means can include means for converting the at least one tow into a layer having a first side and a second side, and the applying means can include means for directing minute droplets of a liquid or liquefied softening agent against the two sides of the layer in the second portion of the predetermined path.

Furthermore, the stretching means can include means (such as the aforediscussed sets of rotary tow contacting elements) for subjecting the filaments of the at least one tow to a predetermined tensional stress (or to a predetermined range of tensional stresses), and such apparatus can further comprise means for relaxing the tensional stress upon the filaments of the at least one tow in the second portion of the predetermined path.

The configuration of the predetermined path can be such that its third portion is at least substantially vertical. At least one of the advancing and gathering means can include means for moving successive increments of the at least one tow from a lower level to a higher level along the third portion of the predetermined path, particularly along the aforementioned at least substantially vertical third portion of the path.

The length of the first portion of the path (as seen in the predetermined direction) can equal or at least approximate the length of the third portion of the path.

The improved apparatus can further comprise means for subjecting the at least one tow to a preliminary stretching action in a fourth portion of the path upstream of the first portion, i.e., between the source and the stretching means. The fourth portion of the path can slope downwardly, i.e., it can have a horizontal component and a vertical component, and the advancing means can be designed to move successive increments along the fourth portion of the path from a higher level to a lower level. The apparatus can further comprise means for conditioning the at least one tow in the fourth portion of the path (i.e., upstream of the first portion) in order to impart to the at least one tow an at least substantially constant moisture content. For example, the conditioning means can include adjustable means for expelling surplus moisture from the at least one tow in the fourth portion of the path, and such expelling means can comprise at least one infrared heater.

In accordance with a presently preferred embodiment of the invention, the means for subjecting the at least one tow to a preliminary stretching action in the fourth portion of the predetermined path can comprise a first set of rotary tow contacting elements which are driven at a first peripheral speed, and a second set of rotary tow contacting elements driven at a higher second peripheral speed and being located downstream of the first set. The second set of rotary tow contacting elements forming part of the means for subjecting the at least one tow to a preliminary stretching action can form part of the stretching means. Such stretching means can further comprise a third set of rotary tow contacting elements disposed downstream of the second set and driven at a peripheral speed higher than the second speed. The rotary tow contacting elements of the first and/or the second set can be driven by the advancing at least one tow.

The apparatus can further comprise at least one so-called banding device which includes means for directing streams of a gaseous fluid (e.g., air) agaist the at least one tow advancing along the predetermined path. The at least one banding device can be adjacent a portion of the path upstream of the first portion, e.g., upstream of the aforementioned means for subjecting the at least one tow to a preliminary stretching action.

At least one of the stretching, applying and gathering means can include at least one pair of driven rotary tow contacting elements (e.g., in the form of rollers having at least substantially parallel axes). The at least one pair of driven tow contacting elements can include a first element having a smooth peripheral surface an a body consisting of or containing an elastic material adjacent the smooth peripheral surface, and a second element having a grooved (e.g., circumferentially grooved) peripheral surface and a body contaning or consisting of a rigid material adjacent the grooved peripheral surface.

The apparatus can further comprise means for applying to the filaments of the at least one tow an electrostatic charge upstream of the second portion of the path, i.e., ahead of the applying means. Such apparatus can also comprise means for relieving the filaments of the at least one tow of such electrostatic charge downstream of the second portion of the predetermined path.

As already mentioned hereinbefore, the apparatus can comprise means for conditioning the at least one tow in a (fourth) portion of the path upstream of the first portion of the path. The conditioning means can include adjustable means for varying the moisture content of successive increments of the at least one tow, and such apparatus can further include means for monitoring the moisture content of the at least one tow in a (fifth) portion of the path downstream of the (fourth) portion at the adjustable moisture varying means. The monitoring means can include means for adjusting the means for varying the moisture content of successive increments of the advancing at least one tow as a function of changes of monitored moisture content, e.g., in response to deviation of the monitored moisture content from a preselected or predetermined moisture content). The apparatus can further comprise means for applying an electrostatic charge to the filaments of the at least one tow upstream of the fifth portion of the path, and the monitoring means can include means for ascertaining the strength and/or one or more other parameters of the electrostatic charge.

The advancing means of the improved apparatus can include means for simultaneously advancing a plurality of tows from the aforementioned source or from discrete sources along a plurality of elongated paths. The stretching means of such apparatus can include means for simultaneously stretching all of the tows, the applying means can include means for simultaneously applying at least one treating agent to each of the plurality of tows, and the gathering means can include means for simultaneously gathering the filaments of each of the plurality of tows.

The apparatus can be designed in such a way that it comprises additional advancing means for advancing at least one additional tow in a predetermined direction along a second elongated path, additional stretching means for stretching the second tow in a first portion of the second path, additional means for applying at least one treating agent to the stretched filaments of the at least one additional tow in a second portion of the second path downstream of the first portion of such path, and means for gathering the filaments of the at least one additional tow in a third portion of the second path downstream of the second portion of such path. The first, second and third portions of the second path can together constitute a substantially U-shaped part of the second path.

The novel features which are considered as characteristic of the invention are set forth in particular in the appended claims. The improved apparatus itself, however, both as to its construction and the mode of assembling and utilizing the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
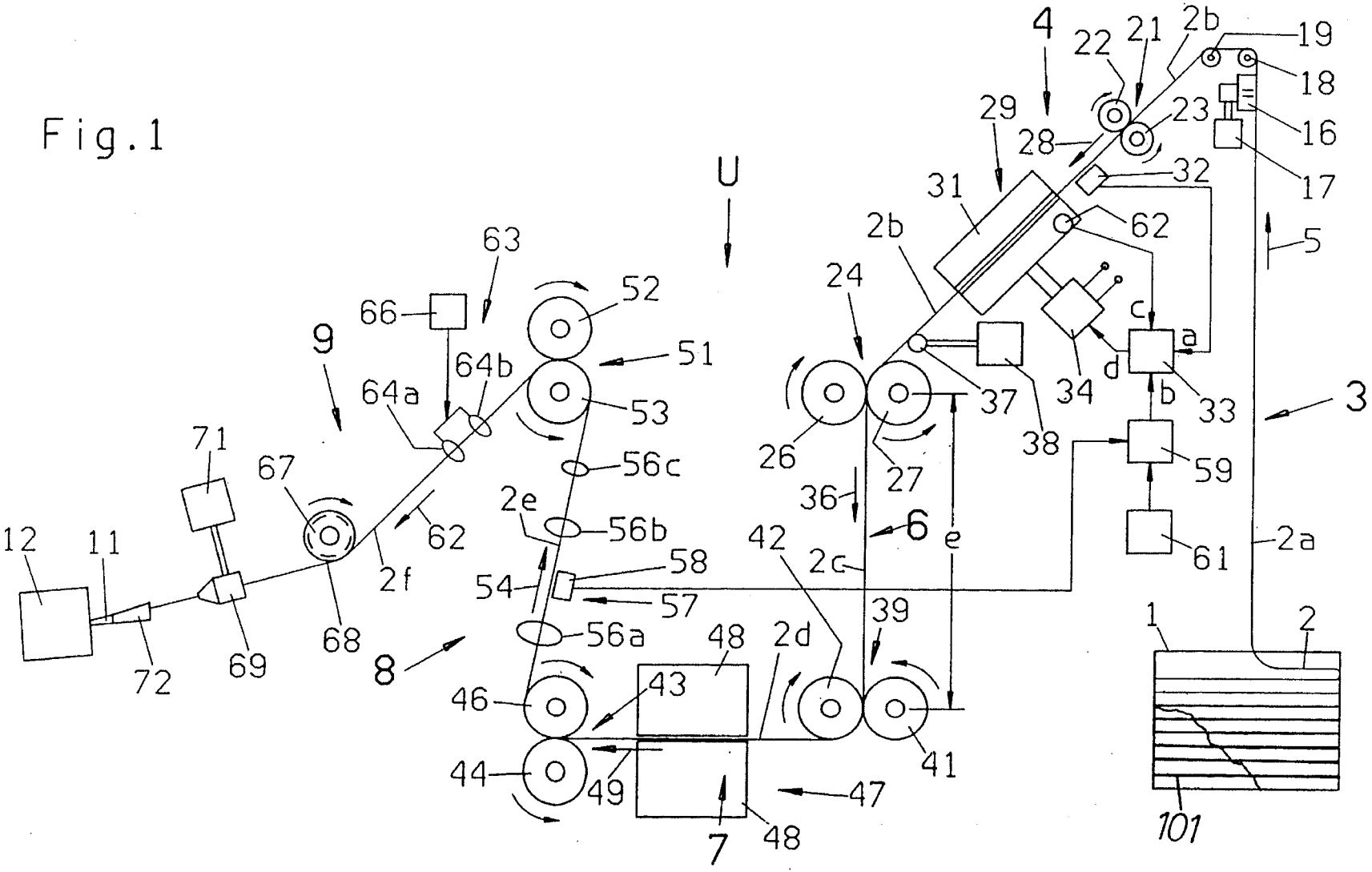
FIG. 1 is a diagrammatic elevational view of an apparatus which embodies one form of the present invention and wherein the means for applying a softening agent to successive increments of at least one running tow is located at a level below the tow stretching means and the tow gathering means.

The apparatus which is shown in FIG. 1 comprises a source 1 (e.g., a bale in a suitable receptacle or magazine) of a continuous tow 2 of filamentary filter material for tobacco smoke. For example, the tow 2 can consist of cellulose acetate fibers which are in part crimped and/or in part interlaced with each other. The apparatus includes a unit 51 which forms part of means for advancing the continuous tow 2 along an elongated path in a predetermined direction as indicated by the arrows 5, 28, 36, 49 and 54. The path includes a portion 3 wherein successive increments of a tow section **2*a* advance at least substantially vertically upwardly toward a first deflecting roll 18 and past a banding device 16 of the type disclosed, for example, in commonly owned U.S. Pat. No. 4,259,769 granted Apr. 7, 1981 to Greve et al. for "Method and apparatus for banding tows of filamentary material". Successive increments of the tow 2 then advance over a second deflecting roll 19 which is located downstream of the roll 18, as seen in the direction of advancement of the tow 2 toward the nip of the horizontal rotary tow contacting elements 52 and 53 (hereinafter called rolls for short) forming part of the advancing unit 51**.

The second or downstream deflecting roll 19 is followed by a downwardly sloping portion 4 of the path for successive increments of a tow section **2*b*; such increments advance between two sets or pairs 21, 24 of rotary tow contacting elements or rolls 22, 23 and 26, 27, respectively, which together constitute means for subjecting successive increments of the running tow to a preliminary or initial stretching or elongating action. The portion 4 of the path for the running tow 2 is followed by an at least substantially vertically downwardly extending portion 6 wherein successive increments of a tow section 2*c* are acted upon by a stretching unit including the aforementioned set or pair 24 of rolls 26, 27 and a set or pair 39 of rotary tow contacting elements or rolls 41, 42. The path portion 6 is followed by an at least substantially horizontal path portion 7 between the rolls 41, 42 and a pair or set 43 of rotary tow contacting elements or rolls 44, 46. Successive increments of the tow section 2*d* between the rolls 41, 42 and 44, 46 are contacted by minute droplets of sprays or streams of a liquid softening agent (such as triacetin) which serves to soften spaced-apart portions of the filaments forming part of the tow 2 so that the thus softened portions of neighboring filaments can adhere to each other in order to establish a maze of minute passages for the flow of tobacco smoke from the lighted end of a filter cigarette or another filter tipped rod-shaped article of the tobacco processing industry into the mouth of a smoker. The means which applies droplets of a suitable softening agent to the filaments of the tow section 2*d* in the path portion 7 includes an applying unit 47** which can be of the type disclosed in commonly owned U.S. Pat. No. 4,313,974 granted Feb. 2, 1982 to Greve et al. for "Method of applying atomized liquid plasticizer to a running tow of filamentary filter material".

The path portion 7 is followed by a substantially vertically upwardly extending portion 8 wherein successive increments of the tow section **2*e* are subjected to the action of a gathering device including the components 56*a*, 56*b*, 56*c* which serve to reduce the width of the tow 2 (as seen at right angles to the plane of FIG. 1). The gathering device is located upstream of the nip of the rolls 52, 53 forming part of the pair or set 51 which, in turn, forms part of the means for advancing the tow 2 along the elongated path including the portions 3, 4, 6, 7, 8 and 9. The path portion 9 is located downstream of the nip of the rolls 52, 53 and successive increments of the tow section 2*f* in the path portion 9 advance toward the inlet 11 of a filter rod making machine 12, e.g., a machine known as KDF 2 or KDF 3** distributed by the assignee of the present application.

The banding device 16 can be used alone or in combination with one or more additional banding devices. For example, a second banding device can be adjacent the path portion 3 upstream of the banding device 16, and one or more banding devices can be adjacent the path portion 4 and/or 6. Reference may be had, for example, to commonly owned copending patent application Ser. No. 08/030,627 filed by Chehab et al. and showing a plurality of banding devices adjacent the paths of two or more continuous running tows. The illustrated banding device 16 includes a source 17 of pressurized gaseous fluid (e.g., compressed air) and one or more nozzles which direct streamlets or jets of compressed gaseous fluid against successive increments of the tow section **2*a* in the path portion 3. Such treatment ensures that the filaments of the tow 2 are either separated from each other or are more readily separable from each other during advancement along the next-following portions 4, 6 and 7 of the elongated path for the tow. Moreover, the banding device 16 serves to increase the width of the running tow 2 in a direction at right angles to the plane of FIG. 1 so that successive increments of the tow portion 2*a* reaching the deflecting rolls 18 and 19** together form a relatively wide layer or carpet of longitudinally extending filaments of filter material for tobacco smoke.

The rolls 22, 23 of the pair or set 21 are driven by the advancing increments of the tow section **2*b* downstream of the deflecting roll 19. On the other hand, the shaft of the roll 26 and/or 27 is driven by a suitable variable speed prime mover (e.g., an electric motor, not specifically shown) so that the peripheral speed of the rolls 26, 27 exceeds the peripheral speed of the rolls 22 and 23. In other words, the filaments of the tow section 2*b* are stretched or elongated on their way from the nip of the rolls 22, 23 toward the nip of the rolls 26, 27. This is a preliminary or initial stretching action which is followed by a stretching action in the path portion 6 between the nip of the rolls 26, 27 and the nip of the rolls 41, 42. The shaft of at least one of the rolls 44, 46 is driven by a suitable variable speed prime mover (e.g., an electric motor, not shown) so that the peripheral speed of the rolls 41, 42 exceeds the peripheral speed of the rolls 26, 27**.

This ensures that successive increments of the tow section 2*d* are adequately stretched (e.g., such filaments can be at least substantially parallel to each other) during advancement through the unit 47 which is preferably designed to spray minute droplets of a softening agent against both sides of the layer or carpet of stretched filaments forming part of the tow section 2*d* between the nip of the rolls 41, 42 forming part of the set or pair 39 and the nip of the rolls 44, 46 forming part of the set or pair 43. The path portion 7 extends substantially at right angles to the path portion 6.

It is also possible to provide a prime mover for the rolls 22, 23 of the pair or set 21; for example, the rolls 22, 23 can be driven at a peripheral speed which is a predetermined fraction of the peripheral speed of the rolls 26, 27. This ensures that the filaments of the tow section 2*b* in the path portion 4 undergo a preselected preliminary or initial stressing or stretching on their way into the path portion 6 where the filaments are stretched again to an extent which is a function of the difference between the peripheral speeds of the rolls 26, 27 and 41, 42.

The force with which the filaments of the tow 2 are engaged at the nips of the rolls 22, 23 and/or 26, 27 and/or 41, 42 can be regulated by mounting at least one roll of at least one of the pairs or sets 21, 24 and 39 for movement radially of and toward or away from the axis of the respective companion roll.

On their way from the nip of the rolls 22, 23 to the nip of the rolls 26, 27, the filaments of the tow section 2*b* advance through a conditioning unit 29 which, in the embodiment of FIG. 1, comprises a heater 31 (e.g., an infrared heater) which serves to impart to the tow an at least substantially constant moisture content before successive increments of the tow 2 reach the path portion 6. The infrared heater 31 is adjustable so that it can select or vary the moisture content of (the quantity of water in) successive unit lengths of tow advancing toward and into the path portion 6. Heaters of the type suitable for use in the conditioning unit 29 of FIG. 1 are distributed by HAUG GmbH & Co. KG, Leinfelden-Echterdingen, Federal Republic Germany, and are known as WECO-HEAT dryers.

The controls for the heater 31 in the conditioning unit 29 of FIG. 1 include a conventional speed monitoring device 32 which is adjacent the path portion 4 upstream of the heater 31 and transmits signals denoting the speed of the tow section 2*b* to the input a of a control unit 33. The speed monitoring device 32 can be designed to directly or indirectly ascertain the speed of movement of the tow section 2*b*, e.g., by monitoring the peripheral speed of the roll 26 and/or 27. The output d of the control unit 33 transmits signals to a source 34 of electrical energy for the heater 31. The control unit 33 is designed to increase the heating action of the heater 31 in response to increasing speed of the tow section 2*b* and vice versa.

The heater 31 of the conditioning unit 29 is located immediately or closely upstream of a device 37 (e.g., a rod or bar extending transversely of the path portion 4) which serves to apply an electrostatic charge to the filaments forming part of the tow section 2*b* and advancing toward the path portion 6 wherein the filaments are subjected to the second or main stretching or elongating action. The charging unit for the device 37 is shown at 38. A device which can be utilized at 37 in the apparatus of FIG. 1 is distributed by the aforementioned German firm HAUG GmbH & Co. KG under the designation ALS A030-500, and the same firm distributes a charging unit (38) under the designation AG-3 neg/7612 and AG-3 post/7609. The high-potential electrostatic charges which are being applied by the device 37 enhance the separation of certain filaments which continue to adhere to each other because the charges which are applied to neighboring filaments in the tow section 2*b* tend to repel each other. Reference may be had, for example, to U.S. Pat. No. 3,817,211 granted Jun. 18, 1974 to Brown et al. for "Apparatus for impregnating strands, webs, fabrics and the like" and to U.S. Defensive Publication No. 665,476 (refer to the Official Gazette No. 860/3 of the U.S. Patent and Trademark Office, published Mar. 18, 1969).

The path portion 6 (wherein successive increments of the tow section 2*c* advance from a higher level to a lower level as indicated by the arrow 36) may but need not be exactly vertical, and the same applies for the path portion 8 wherein successive increments of the tow section 2*e* advance from a lower level to a higher level as indicated by the arrow 54.

The stretching action in the path portion 6 can be regulated by varying the speed of the prime mover which drives the roll 26 and/or 27 of the pair or set 24 and/or by varying the speed of the prime mover which drives the roll 41 and/or 42 of the pair or set 39. At any rate, the peripheral speed of the rolls 41, 42 must exceed the peripheral speed of the rolls 26, 27 if the filaments of the tow section 2*c* are to be subjected to a stretching action in addition to that which takes place between the nips of the rolls 22, 23 and 26, 27.

It is preferred to design the rolls 26, 27 of the pair or set 24 in such a way that the peripheral surface of one of these rolls (e.g., of the roll 26) is provided with grooves (e.g., circumferentially extending or helical grooves) and is adjacent a rigid portion or body of the respective roll, and that the peripheral surface of the other roll (e.g., the roll 27) is smooth and is adjacent a resilient portion or body of the respective roll. The same holds true for at least one additional pair or set of rolls, e.g., the rolls 41, 42 of the set or pair 39 at the downstream end of the path portion 6. Reference may be had to U.S. Pat. No. 3,317,965 granted May 9, 1967 to Murakami for "Tow filament separating apparatus", to U.S. Pat. No. 3,255,506 granted Jun. 14, 1966 to Fritz for "Tow treatment", and to filter tow treating apparatus known as AF 1, AF 2 and AF 3, all distributed by the assignee of the present application.

In accordance with a feature of the present invention, the length e of the path portion 6 between the nips of the rolls 26, 27 and 41, 42 forming part of the stretching unit is between about 800 mm and 1200 mm, preferably approximately 1000 mm. It has been ascertained that, quite surprisingly, the primary or main stretching action is particularly satisfactory if the length of the path portion 6 is within the aforementioned range.

At least one of the rolls 44, 46 forming part of the pair or set 43 at the downstream end of the path portion 7 is driven, preferably by a variable speed electric motor or another suitable prime mover. As a rule, the peripheral speed of the rolls 44, 46 is at least slightly less than the peripheral speed of the rolls 41, 42, i.e., the filaments of the tow section 2*d* in the path portion 7 are free to relax, at least slightly, during application of minute droplets of a softening agent by the unit 47. The peripheral surface of the roll 44 or 46 is preferably grooved and is adjacent a rigid portion or body of the respective roll, and the peripheral surface of the roll 46 or 44 is preferably smooth and is adjacent a resilient portion or body of the respective roll, the same as described hereinbefore in connection with the rolls 26, 27 of the set or pair 24.

The characters 48 denote two components of the applying unit 47 which is or which can be identical with or similar to that disclosed in the aforementioned U.S. Pat. No. 4,313,974 to Greve et al. The softening agent (such as triacetin) is preferably applied by spray nozzles or analogous liquid dispersing implements so that the minute droplets of such liquid impinge upon both sides of the layer or carpet of filaments forming part of the tow section 2*d* advancing (in the direction of the arrow 49) from the nip of the rolls 41, 42 through the unit 47 and toward the nip of the rolls 44, 46.

The spreading action of one or more banding devices (including the banding device 16) as well as of the deflecting rolls 18, 19 and pairs of rolls 22, 23 and 26, 27 is preferably such that the width of the layer or carpet of filaments forming part of the tow sections 2*c* and 2*d* is between about 120 mm and 150 mm. The formation of such relatively narrow tow sections 2*c* and 2*d* is particularly desirable and advantageous if the apparatus of FIG. 1 is designed or converted for simultaneous treatment of two or more discrete tows of filamentary filter material for tobacco smoke. This is shown schematically in the right-hand portion of FIG. 1, i.e., the bale 1 is located in front of a second bale 101 which supplies a second discrete tow of filamentary filter material. The second tow can be treated by the units which treat the illustrated tow 2 or by discrete units which may but need not be identical with the illustrated units (e.g., the initial stretching unit adjacent the path portion 4, the main stretching unit adjacent the path portion 6, the applying unit 47 adjacent the path portion 7 and the gathering unit adjacent the path portion 8). If the apparatus of FIG. 1 is designed or converted for simultaneous treatment of two or more tows, the paths for such tows can be located one behind the other as seen at right angles to the plane of FIG. 1. The two or more simultaneously processed tows can be advanced into discrete filter rod making machines 12 or into a machine which is designed to simultaneously form two or more continuous filter rods ready to be subdivided into filter rod sections of unit length or multiple unit length.

The roll 52 and/or 53 of the unit 51 is driven by a variable-speed electric motor or another suitable prime mover. The peripheral surface of the roll 52 or 53 can be provided with grooves adjacent a rigid portion or body of the respective roll, and the roll 53 or 52 is then preferably provided with a smooth peripheral surface adjacent a resilient portion or body of the respective roll, the same as described with reference to the rolls 26, 27 forming part of the set 24 and the rolls 44, 46 of the set 43.

The components 56*a*, 56*b*, 56*c* of the gathering unit adjacent the path portion 8 can include or constitute loops made of wire and serving to reduce the width of the tow 2 as seen at right angles to the plane of FIG. 1. The gathering action is preferably gradual and the illustrated gathering unit can include four or more components disposed one behind the other (as seen in the direction of the arrow 54) to establish a succession of passages with each downstream passage narrower than the preceding passage.

The apparatus of FIG. 1 further comprises means 57 for monitoring the moisture content of filaments forming part of the tow section 2*e* in the path portion 8. The monitoring means 57 includes a detector 58 which is adjacent the path portion 8 and serves to transmit signals denoting the ascertained strength of the field developed by the electrostatic charges of filaments advancing in the direction of the arrow 54. The electrostatic charges which are carried by the filaments of the tow 2 in the path portion 8 are caused by stretching of the tow section 2*c* between the nips of the rolls 26, 27 and 41, 42 rather than by the action of the charging device 37. In other words, the device 37 is or can be idle if the monitoring means 57 is in use and vice versa. The signals which are transmitted by the detector 58 of the monitoring means 57 are indicative of the moisture (water) content of successive increments of the tow section 2*e* between the components 56*a* and 56*b* of the gathering unit. The signals at the output of the detector 58 are transmitted to the corresponding input of a signal comparing stage 59. Another input of the stage 59 receives signals from a preferably adjustable source 61 of reference signals, and the output of the stage 59 transmits signals to the input b of the control unit 33 when the intensity and/or other characteristics of signals from the detector 58 depart from the intensity and/or other characteristics of the reference signals furnished by the source 61.

A further input c of the control unit 33 receives signals from a thermometer 62 in or on or at the infrared heater 31 forming part of the conditioning unit 29. The control unit 33 processes the signals transmitted to its inputs a, b and c in such a way that the signals transmitted by its output d cause the heater 31 to maintain the moisture content of successive increments of the tow section 2*b* advancing beyond the conditioning unit 29 at a desired constant value. The combination of the conditioning unit 29, control unit 33, stage 59, signal source 61 and monitoring means 57 is believed to constitute a patentable improvement in as well as independently of the tow processing apparatus shown in FIGS. 1 and 2.

The apparatus of FIG. 1 further comprises a unit 63 which is adjacent the path portion 9 and serves to relieve the filaments of the tow section 2*f* of electrostatic charges which are or which might be undesirable in connection with further processing of the tow 2. The unit 63 can include or constitute an ionizing device having annular electrodes 64*a*, 64*b* connected to a main supply circuit 66. The electrodes 64*a*, 64*b* can be of the type known as EI-RE 014-200 and the circuit 66 can be of the type known as EN-7/7703, both distributed by the German Firm HAUG GmbH & Co. KG.

The unit 63 is followed by a driven deflecting roll 67 which changes the direction of advancement of successive increments of the tow section 2*f*. The peripheral speed of the roll 67 can match or approximate the speed of oncoming increments of the tow section 2*f*, and the peripheral surface of the roll 67 is provided with a circumferentially extending recess or groove 68 bounded by a suitably rounded portion of the peripheral surface.

The apparatus of FIG. 1 further comprises a standard nozzle 69 which is disposed downstream of the deflecting roll 67 and is connected to a source 71 of compressed gaseous fluid, e.g., air. The character 72 denotes a so-called horn which determines the cross-sectional area of successive increments of the tow section 2*f* advancing toward and beyond the inlet 11 of the filter rod making machine 12 (see the arrow 62).

In accordance with a further advantageous feature of the invention, the portions 6, 7 and 8 together constitute a substantially U-shaped part U of the path for the tow 2 from the source or bale 1 to the filter rod making machine 12. The inclination of the tow portion 8 relative to the tow portion 6 can be greater than that shown in FIG. 1, i.e., the rolls 52, 53 can be moved even closer to the rolls 26, 27 to thus further reduce the length of the apparatus between the bale 1 and the machine 12.

The mode of operation of the apparatus of FIG. 1 is as follows:

The advancing unit including the rolls 52, 53 draws a continuous tow 2 from the bale 1 and such tow advances along the path including the sections 3, 4, 6, 7, 8 and 9 toward and into the inlet 11 of the filter rod making machine 12. The banding device 16 spreads the filaments of the tow section 2*a* in a direction at right angles to the plane of FIG. 1, and the thus obtained carpet or layer continues to advance in the direction of arrow 5 toward and over the deflecting rolls 18, 19 into the path portion 4, i.e., into the range of the conditioning unit 29. The heater 31 of the conditioning unit 29 is regulated by the control unit 33 so that the moisture content of successive increments of the tow section 2*b* advancing toward the nip of the rolls 26, 27 matches a desired constant value. The rod or bar 37 applies an electrostatic charge to the filaments of the tow section 2*b* between the heater 31 and the rolls 26, 27. The application of electrostatic charges contributes to more satisfactory separation of neighboring filaments from each other. The tow section 2*c* is stretched in the path portion 6 because the peripheral speed of the rolls 41, 42 exceeds the peripheral speed of the rolls 26, 27.

The tensional stress upon the filaments of the tow section 2*d* is relaxed in the path portion 7 because the peripheral speed of the rolls 44, 46 is less than the peripheral speed of the rolls 41, 42. The components 48 of the applying unit 47 spray droplets of a softening agent against both sides of the layer or carpet which constitutes the tow section 2*d* in the path portion 7. The width of the thus treated tow section 2*e* is thereupon reduced by the components 56*a*, 56*b*, 56*c* of the gathering unit upstream of the nip of the rolls 52, 53 because the width of the passages defined by successive components 56*a* to 56*c* decreases in a direction at right angles to the plane of FIG. 1.

The detector 58 of the monitoring unit 57 ascertains the moisture content of successive increments of the tow section 2*e* in the path portion 8 and transmits corresponding signals to the respective input of the signal comparing stage 59. In other words, such signals are processed by the control unit 33 to regulate the action of the heater 31 in the conditioning unit 29.

The electrodes 64*a*, 64*b* relieve the filaments of the tow section 2*f* of electrostatic charges upstream of the deflecting roll 67 and the surface bounding the circumferential groove 68 of the roll 67 reduces the width of the oncoming increments of the tow section 2*f* before such increments reach and advance through the stuffing nozzle 71 upstream of the horn 72 which directs successive increments of the thus obtained rope-like tow into the inlet 11 of the filter rod making machine 12. The machine 12 comprises means for compacting the rope advancing beyond the nozzle 71 so that the rope is converted into a rod-like filler which is draped into a continuous web of cigarette paper, artificial cork or other suitable wrapping material in a manner not forming part of the present invention.

An important advantage of the feature that the distance e between the nips of the rolls 26, 27 and 41, 42 is between about 800 mm and 1200 mm (preferably about 1000 mm) is that the tow yield (namely the quantity of filamentary filter material per unit length of the filter rod) is greatly superior to that achieved with heretofore known apparatus. The resistance which the filter rod sections or mouthpieces obtained from the filter rod formed in the machine 12 offer to the flow of tobacco smoke is uniform which constitutes a highly desirable feature of filter mouthpieces of filter cigarettes, cigars, cigarillos or other rod-shaped smokers' products of the tobacco processing industry.

As already mentioned above, the width of the tow section 2*b*, 2*c* and/or 2*d* need not exceed 150 mm, and this renders it possible to simultaneously process two or more tows (which can be drawn from a common source or from discrete sources) without appreciably increasing the bulk, the initial cost and the maintenance cost of the apparatus. For example, if the apparatus of FIG. 1 is designed to simultaneously process two tows which are respectively drawn from the bales 1 and 101 and are caused to advance along two similar paths (so that the path for the second tow issuing from the bale 101 is located behind the path for the tow 2 shown in FIG. 1), at least some of the afore-described units which are utilized to treat the tow 2 can also serve to treat the other tow. The rolls 22, 23 and/or 26, 27 and/or 41, 42 and/or 44, 46 and/or 52, 53 can be utilized to simultaneously advance and/or otherwise treat two or more discrete tows. The same holds true for the deflecting rolls 18, 19 and/or certain other constituents of the improved apparatus. Thus, it is possible to double the output of the apparatus of FIG. 1 at a cost which is merely a fraction of the cost of two discrete apparatus.

The feature that the length e of the path portion 6 equals or approximates the length of the path portion 8 contributes to compactness of the improved apparatus and ensures that the components of the stretching unit including the rolls 26, 27 and 41, 42 as well as the components 56*a*–56*c* of the gathering unit are readily accessible. The provision of a substantially horizontal path portion 7 for the application of droplets of a softening agent also contributes to compactness of the apparatus and to accessibility of the constituents 48 of the applying unit 47.

The means for subjecting the tow 2 to a preliminary stretching action during advancement of successive increments of the tow section 2*b* along the path portion 4 constitutes an optional but desirable and advantageous feature of the improved apparatus. As shown, the path portion 4 for the section 2*b* of the tow 2 shown in FIG. 1 is oriented in such a way that it has a horizontal component and a vertical component. Furthermore, successive increments of the tow section 2*b* advance downwardly on their way from the deflecting roll 19 toward the rolls 26, 27.

The shaft of the roll 22 and/or 23 may but need not be positively driven, e.g., by a variable-speed electric motor or another suitable prime mover. It normally suffices to provide suitable means (of any known design) to urge the roll 22 toward the roll 23 and/or vice versa with a preferably variable force. This ensures that the preliminary stretching action upon the tow section 2*b* can be maintained within a desired range.

The rigid body or portion of the roll 22 or 23 can consist of a metallic material and the peripheral surface of such roll is preferably provided with the afore-mentioned grooves. That portion of the roll 23 or 22 which is adjacent its smooth peripheral surface can be made of rubber or a suitable elastomeric plastic material. The same applies for the other pairs or sets of rolls in the apparatus of FIG. 1.

The banding device 16 also constitutes an optional but desirable and advantageous feature of the improved apparatus. Such device promotes the separation of neighboring filaments in the tow section 2*a* from each other even before successive increments of such filaments are subjected to a stretching action between the rolls 22, 23 and 26, 27 and/or between the rolls 26, 27 and 41, 42, depending upon whether the tow is stretched only along the path portion 6 or along the path portions 4 and 6.

Figure 2:
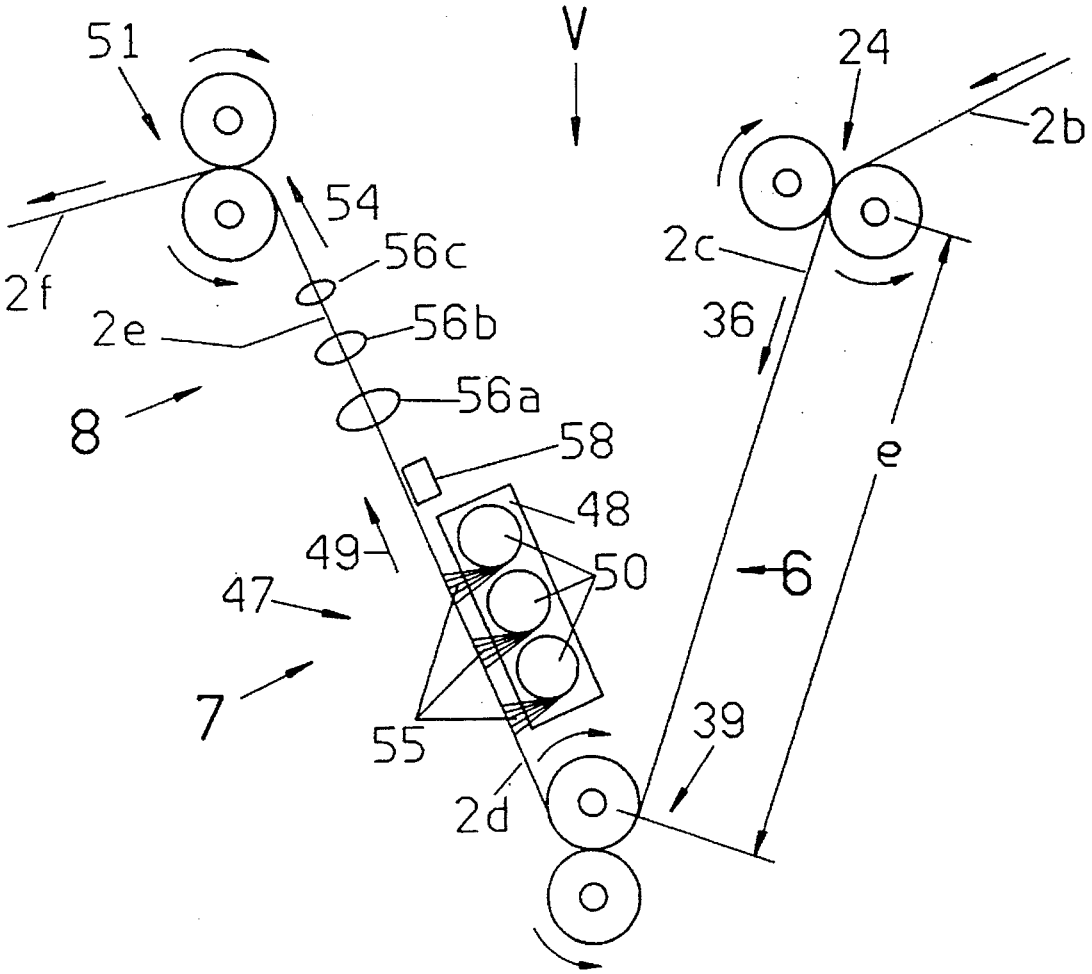
FIG. 2 is a fragmentary diagrammatic elevational view of a modified apparatus wherein the means for applying a softening agent is adjacent an upwardly sloping portion of a path for a single tow or upwardly sloping portions of paths for two or more tows.

FIG. 2 shows a portion of a modified apparatus. All such parts of this modified apparatus which are identical with or clearly analogous to the corresponding parts of the apparatus of FIG. 1 are denoted by similar reference characters. The main difference between the apparatus of FIGS. 1 and 2 is that the portion 7 of that part V of the path shown in FIG. 2, which further includes the path portions 6 and 8, is aligned with the path portion 8. The combined length of the path portions 7, 8 shown in FIG. 2 can but need not appreciably exceed the length e of the path portion 6 between the nips of the rolls forming part of the pair or set 24 and the nip of the rolls forming part of the pair or set 39. The substantially V-shaped part of the modified path shown in FIG.2 can be said to constitute a modified version of the part U shown in FIG. 1, i.e, the width of the web (path portion 7 in FIG. 1) of the part U of the path shown in FIG. 1 has been reduced to zero so that the part V of the path defined by the advancing means of the apparatus of FIG. 2 includes a first leg or portion 6 wherein successive increments of the tow section 2*c* advance downwardly as indicated by the arrow 36 and a second leg or portion 7, 8 wherein successive increments of the tow sections 2*d*, 2*e* move from a lower level to an upper level as indicated by the arrows 49 and 54.

The rolls of the pairs or sets 24 and 39 are driven by discrete variable-speed prime movers or by a single prime mover through the medium of variable-speed transmission means, not shown. The length c of the path portion 6 is between 800 mm and 1200 mm, preferably about 1000 mm.

FIG. 2 merely shows one component 48 of the unit 47 which serves to apply minute droplets of a liquid or liquefied softening or plasticizing agent (such as triacetin) to the filaments of the tow section 2*d*. The component 48 of FIG. 2 employs several rapidly driven rotors 50 which direct thin jets or streamlets 55 of softening agent against the adjacent side of the layer or carpet forming the tow section 2*d*. Liquid spraying or applying units of the type shown at 47 in FIG. 2 can be of the character known as "WEKO-ROTOREN-BEFEUCHTUNG FÜR MATERIALBAHNEN" (meaning "WEKO rotorized moisturizer for material webs") distributed by the Firm Weitmann & Konrad GmbH & Co. KG, Leinfelden-Echterdingen, Federal Republic Germany. It is clear that the unit 47 shown in FIG. 2 can employ two components 48, one at each side of the tow section 2*d*.

The gathering unit including the components 56*a*, 56*b*, 56*c* is immediately adjacent the downstream end of the unit 47, and the detector 58 is located upstream of the first component 56*a* of the gathering unit.

Those units and/or other parts of the apparatus of FIG. 2 which are installed upstream of the path portion 6 and downstream of the path portion 8 are or can be identical with the corresponding units and/or parts of the apparatus which is shown in FIG. 1.

The angle between the two legs of the V-shaped part of the path shown in FIG. 2 can be increased or reduced without departing from the spirit of the invention.

An advantage which is common to the apparatus of FIGS. 1 and 2 is that they ensure a more economical utilization of the filamentary filter material. The consumption of filamentary filter material can be reduced by several percentage points without affecting the resistance which the filter mouthpieces offer to the flow of tobacco smoke. Moreover, the space requirements of the improved apparatus are less than those of heretofore known and utilized apparatus. This applies particularly for the "depth" of the apparatus (as seen at right angles to the plane of FIG. 1 or 2) and, therefore, it is possible to simultaneously process two or more tows which are advanced along similar or identical paths. The apparatus including the structure of FIG. 2 can be designed to simultaneously process two or more tows, the same as the apparatus of FIG. 1.

The disclosures of the aforementioned Defensive Publication and of the aforementioned patents are incorporated herein by reference.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for treating at least one continuous tow of filamentary filter material for tobacco smoke, comprising means for advancing the at least one tow from a source along an elongated path in a predetermined direction; means for stretching the filaments of the at least one tow in a first portion of said path; means for applying at least one treating agent to the stretched filaments of the at least one tow in a second portion of said path downstream of and inclined relative to said first portion; and means for gathering the filaments of the at least one tow in a third portion of said path downstream of said second portion, said first, second and third portions together constituting a substantially U-shaped part of said path.

2. Apparatus for treating at least one continuous tow of filamentary filter material for tobacco smoke, comprising means for advancing the at least one tow from a source along an elongated path in a predetermined direction; means for stretching the filaments of the at least one tow in a first portion of said path; means for applying at least one treating agent to the stretched filaments of the at least one tow in a second portion of said path downstream of said first portion, said applying means including means for spraying a softening agent onto the stretched filaments of the at least one tow in said second portion of said path; and means for gathering the filaments of the at least one tow in a third portion of said path downstream of said second portion, said first, second and third portions together constituting a substantially U-shaped part of said path.

3. The apparatus of claim 1, wherein successive increments of the at least one tow advancing beyond said applying means have a first width and said gathering means includes means for reducing the width of successive increments of the at least one tow in said third portion of said path.

4. The apparatus of claim 1, wherein said first portion of said path has a length of between approximately 800 and 1200 mm, as seen in said direction.

5. The apparatus of claim 4, wherein said length is approximately 1000 mm.

6. The apparatus of claim 1, wherein said stretching means includes a first set of rotary tow contacting elements driven at a first peripheral speed and a second set of rotary tow contacting elements driven at a higher second peripheral speed and engaging successive increments of the advancing tow downstream of said first set.

7. The apparatus of claim 1, wherein at least one of said stretching and applying means includes means for imparting to the at least one tow a width of between approximately 120 and 150 mm in the respective portion of said path.

8. The apparatus of claim 1, wherein said first portion of said path is at least substantially vertical.

9. The apparatus of claim 8, wherein said stretching means includes means for moving successive increments of the at least one tow from a higher level to a lower level.

10. The apparatus of claim 1, wherein said part of said path includes a downwardly sloping first leg and an upwardly sloping second leg, said first portion forming part of said first leg and said second and third portions forming part of said second leg of said substantially U-shaped part of said path.

11. The apparatus of claim 10, wherein said gathering means is at least closely adjacent said applying means.

12. Apparatus for treating at least one continuous tow of filamentary filter material for tobacco smoke, comprising means for advancing the at least one tow from a source along an elongated path in a predetermined direction; means for stretching the filaments of the at least one tow in a first portion of said path, said means for stretching including means for converting the at least one tow into a layer having a first side and a second side; means for applying at least one treating agent to the stretched filaments of the at least one tow in a second portion of said path downstream of said first portion, said means for applying including means for directing minute droplets of a liquid softening agent against said sides of the layer in said second portion of said path; and means for gathering the filaments of the at least one tow in a third portion of said path downstream of said second portion, said first, second and third portions together constituting a substantially U-shaped part of said path.

13. Apparatus for treating at least one continuous tow of filamentary filter material for tobacco smoke, comprising means for advancing the at least one tow from a source along an elongated path in a predetermined direction; means for stretching the filaments of the at least one tow in a first portion of said path, said means for stretching including means for subjecting the filaments of the at least one tow to a predetermined tensional stress; means for applying at least one treating agent to the stretched filaments of the at least one tow in a second portion of said path downstream of said first portion; means for relaxing the tensional stress upon the filaments in said second portion of said path; and means for gathering the filaments of the at least one tow in a third portion of said path downstream of said second portion, sad first, second and third portions together constituting a substantially U-shaped part of said path.

14. The apparatus of claim 1, wherein said third portion of said path is at least substantially vertical.

15. The apparatus of claim 14, wherein at least one of said gathering and advancing means includes means for moving successive increments of the at least one tow from a lower level to a higher level along said third portion of said path.

16. The apparatus of claim 1, wherein said first portion of said path has a first length, as seen in said direction, and said third portion of said path has a second length at least approximating said first length.

17. Apparatus for treating at least one continuous tow of filamentary filter material for tobacco smoke, comprising means for advancing the at least one tow from a source along an elongated path in a predetermined direction; means for stretching the filaments of the at least one tow in a first portion of said path; means for applying at least one treating agent to the stretched filaments of the at least one tow in a second portion of said path downstream of said first portion; means for gathering the filaments of the at least one tow in a third portion of said path downstream of said second portion, said first, second and third portions together constituting a substantially U-shaped part of said path; and means for subjecting the at least one tow to a preliminary stretching action in a fourth portion of said path upstream of said first portion.

18. The apparatus of claim 17, wherein said fourth portion of said path has a horizontal and a vertical component.

19. The apparatus of claim 18, wherein said advancing means includes means for moving successive increments of the at least one tow from a higher level to a lower level along said fourth portion of said path.

20. The apparatus of claim 17, further comprising means for conditioning the at least one tow in said fourth portion of said path so as to impart to the at least one tow an at least substantially constant moisture content.

21. The apparatus of claim 20, wherein said conditioning means includes adjustable means for expelling moisture from the at least one tow in said fourth portion of said path.

22. The apparatus of claim 21, wherein said moisture expelling means includes at least one infrared heater.

23. The apparatus of claim 17, wherein said means for subjecting the at least one tow to a preliminary stretching action comprises a first set of rotary tow contacting elements driven at a first peripheral speed and a second set of rotary tow contacting elements driven at a higher second peripheral speed and disposed downstream of said first set, said second set of rotary tow contacting elements forming part of said stretching means.

24. The apparatus of claim 23, wherein said stretching means further comprises a third set of rotary tow contacting elements disposed downstream of said second set and driven at a peripheral speed higher than said second speed.

25. The apparatus of claim 23, wherein at least one of said first and second rotary tow contacting elements is driven by the advancing at least one tow.

26. The apparatus of claim 1, further comprising at least one tow banding device adjacent a fourth portion of said path upstream of said first portion.

27. The apparatus of claim 1, further comprising at least one banding device adjacent said path and including means for directing streams of a gaseous fluid against the at least one tow advancing along said path.

28. The apparatus of claim 1, wherein at least one of said stretching, applying and gathering means includes at least one pair of driven rotary tow contacting elements including a first element having a smooth peripheral surface and a body of elastic material adjacent said surface and a second element having a grooved peripheral surface and a body of rigid material adjacent said grooved peripheral surface.

29. The apparatus of claim 1, further comprising means for applying an electrostatic charge to the filaments of the at least one tow upstream of said second portion of said path.

30. The apparatus of claim 29, further comprising means for relieving the filaments of the at least one tow of said electrostatic charge downstream of said second portion of said path.

31. Apparatus for treating at least one continuous tow of filamentary filter material for tobacco smoke, comprising means for advancing the at least one tow from a source along an elongated path in a predetermined direction; means for stretching the filaments of the at least one tow in a first portion of said path; means for applying at least one treating agent to the stretched filaments of the at least one tow in a second portion of said path downstream of said first portion; means for gathering the filaments of the at least one tow in a third portion of said path downstream of said second portion, said first, second and third portions together constituting a substantially U-shaped part of said path; means for conditioning the at least one tow in a fourth portion of said path upstream of said first portion including adjustable means for varying the moisture content of successive increments of the at least one tow; and means for monitoring the moisture content of the at least one tow in a fifth portion of said path downstream of said fourth portion, said means for monitoring including means for adjusting said means for varying the moisture content as a function of changes of monitored moisture content.

32. The apparatus of claim 31, further comprising means for applying an electrostatic charge to the filaments of the at least one tow upstream of said fifth portion of said path, said means for monitoring including means for ascertaining the strength of said electrostatic charge.

33. The apparatus of claim 1, wherein said advancing means includes means for simultaneously advancing a plurality of tows from said source along a plurality of elongated paths, said stretching means including means for simultaneously stretching all of said tows, said applying means including means for simultaneously applying at least one flowable treating agent to each of said plurality of tows, and said gathering means including means for simultaneously gathering the filaments of each of said plurality of tows.

34. Apparatus for treating at least one continuous tow of filamentary filter material for tobacco smoke, comprising means for advancing the at least one tow from a source along a predetermined path in a predetermined direction; means for stretching the filaments of the at least one tow in a first portion of said path; means for applying at least one treating agent to the stretched filaments of the at least one tow in a second portion of said path downstream of said first portion; means for gathering the filaments of the at least one tow in a third portion of said path downstream of said second portion, said first, second and third portions together constituting a substantially U-shaped part of said path; additional advancing means for advancing at least one additional tow in a predetermined direction along a second path; additional stretching means for stretching the at least one additional tow in a first portion of said second path; additional means for applying at least one treating agent to the stretched filaments of the at least one additional tow in a second portion downstream of said first portion of said second path; and means for gathering the filaments of the at lease one additional tow in a third portion downstream of the second portion of said second path.

35. The apparatus of claim 34, wherein said first second and third portions of said second path together constitute a substantially U-shaped part of said second path.

* * * * *